US006089839A

United States Patent [19]

Bush et al.

[11] Patent Number: 6,089,839

[45] Date of Patent: Jul. 18, 2000

[54] OPTIMIZED LOCATION FOR SCROLL COMPRESSOR ECONOMIZER INJECTION PORTS

[75] Inventors: James W. Bush, Skaneateles; Alexander Lifson, Manlius, both of N.Y.

[73] Assignee: Carrier Corporation, Farmington, Conn.

[21] Appl. No.: 08/987,222

[22] Filed: Dec. 9, 1997

[51] Int. Cl.[7] ..... F01C 1/02

[52] U.S. Cl. ..... 418/55.1; 418/55.2; 418/15

[58] Field of Search ..... 418/55.1, 15, 55.2

[56] References Cited

U.S. PATENT DOCUMENTS

| | | | |
|---|---|---|---|
| 4,331,002 | 5/1982 | Ladusaw . | |
| 4,514,150 | 4/1985 | Hiraga et al. | 417/440 |
| 4,547,137 | 10/1985 | Terauchi et al. | 418/55 |

FOREIGN PATENT DOCUMENTS

| | | |
|---|---|---|
| 0508293A1 | 4/1992 | European Pat. Off. . |
| 0508293 | 10/1992 | European Pat. Off. . |
| 2095846 | 1/1972 | France . |
| 3301304A1 | 9/1983 | Germany . |
| 07103152 | 4/1995 | Japan . |
| 07103152A | 4/1995 | Japan . |

OTHER PUBLICATIONS

Patent Abstracts of Japan, Publication No. 10037868; Publication Date: Feb. 13, 1998.

Patent Abstracts of Japan, Publication No. 5715384; Publication Date: Sep. 22, 1982.

*Primary Examiner*—Hoang Nguyen

*Attorney, Agent, or Firm*—Howard & Howard

[57] ABSTRACT

The locations of economizer ports in a scroll compressor are optimized such that the ports supply supplemental fluid to compression chambers prior to the outer seal points closing the compression chambers. Thus, the economizer port supplies fluid against a low average pressure and the amount of fluid injected from the economizer port is maximized. The location of the economizer port is preferably selected such that a wave caused in the compression chamber due to the injection of fluid from the economizer port does not reach the outer seal point until the outer seal point closes the compression chamber. Thus, there is no back flow from the economizer port toward the main suction chamber, and no corresponding reductions in the main suction flow.

18 Claims, 2 Drawing Sheets

OPTIMIZED LOCATION FOR SCROLL COMPRESSOR ECONOMIZER INJECTION PORTS

BACKGROUND OF THE INVENTION

This application relates to a compressor wherein the locations of economizer injection ports are optimized.

Scroll compressors are becoming widely utilized in refrigerant compression applications. As known, a pair of scroll members have a base with a spiral wrap extending from the base. One scroll is fixed and the other orbits relative to the fixed scroll. The wraps interfit to define a plurality of compression chambers. The orbiting scroll wrap contacts the fixed scroll wrap to seal and define compression chambers. The compression chambers are moved towards a central discharge port as the orbiting scroll completes its orbiting cycle.

Refrigerant systems are also making increasing use of the economizer cycle in which a portion of the refrigerant is directed back to the compressor at an intermediate pressure between suction pressure and discharge pressure. This refrigerant is injected into the compression chambers through internal ports. This has the effect of increasing both system capacity and efficiency. In systems where the economizer cycle is optimized for maximum capacity increase, the scroll designer seeks to locate the internal ports so as to maximize the amount of injected vapor and to thus minimize the intermediate pressure.

The scroll designer has competing considerations in designing an economizer port for maximum capacity. First, the economizer port must communicate with the compression chamber at a point located as close to the main section chamber as possible but, second, must also be located such that the injected fluid cannot escape back into the main suction chamber. Such an escape of fluid would actually be detrimental to capacity. Thus, economizer ports have commonly been placed at a location such that they do not communicate with a chamber until after the orbiting scroll wrap has sealed the chamber, blocking fluid flow back to the main suction chamber.

This position, dictated by these two competing interests, results in an economizer pressure that is higher than the thermodynamic optimum for maximum capacity. This is due to the fact that the chamber pressure begins to rise as soon as the chamber is sealed off from the main suction chamber and thus the economizer port sees an elevated average pressure which is higher than the minimum pressure for maximum capacity increase. This limitation results in less than optimum capacity increase.

SUMMARY OF THE INVENTION

In the disclosed embodiment of this invention, an economizer port communicates with the compression chamber prior to the compression chamber being sealed off from the main suction chamber. Preferably, the economizer port is positioned such that a compression wave moving from its entrance into and through the compression chamber, and toward the main suction chamber, reaches the location where the compression chamber will be sealed at or shortly after the time that the compression chamber is sealed. That is, the port is positioned far enough into the compression chamber such that the pressure wave resulting from entering economizer fluid does not reach the entrance before the compression chamber is sealed from the main suction chamber. In this way, the injected fluid does not flow back into the main suction chamber. On the other hand, the economizer port delivers fluid for a time into a chamber where pressure is not above suction pressure, since the compression chamber has not been sealed, and thus the average economizer pressure is reduced and the economizer capacity is increased.

In a preferred embodiment of this invention, two economizer ports are positioned as described above, one for each of two paired compression chambers. A formula is described below that may assist the designer in selecting the optimum location for the economizer port. The present invention also defines a method for selecting an optimum economizer port location. With changing scroll wrap geometries and sizes, the desired location of the port may also change. Thus, while a specific embodiment is illustrated in this application, it should be understood that other positions fall within the scope of this patent.

Further, while the disclosure is limited to scroll compressors, other type compressors with economizer circuits may benefit from this invention. Thus, the scope of this patent extends beyond scroll compressors.

These and other features of the present invention can be best understood from the following specification and drawings, of which the following is a brief description.

DETAILED DESCRIPTION OF A PREFERRED EMBODIMENT

Figure 1:
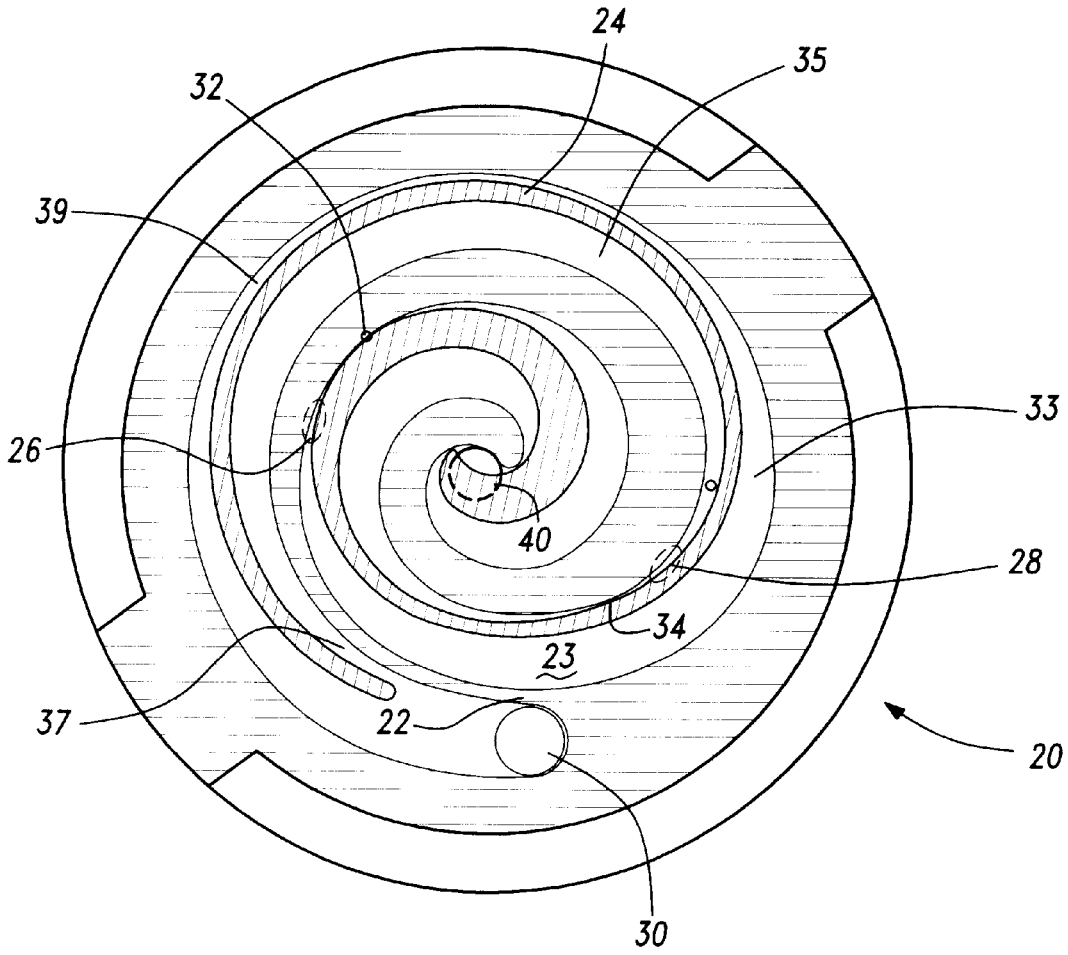
FIG. 1 shows a scroll compressor where wraps are at a location where the economizer ports are first delivering supplemental fluid to the compression chambers, which are still open to the main suction chamber.

FIG. 1 shows a scroll compressor 20 having a non-orbiting scroll wrap, shown here as a fixed scroll wrap 22, and a fixed scroll base 23. An orbiting scroll wrap 24 moves relative to the fixed scroll wrap 22, as known.

A pair of economizer ports 26 and 28 are shown extending through the base 23 of the fixed scroll. The economizer ports 26 and 28 communicate with a source of intermediate pressure fluid in a known manner. Typically, a source of intermediate pressure fluid communicates to an economizer passage, which extends through the fixed scroll base. Ports 26 and 28 communicate to the economizer passage. A preferred structure for the economizer passage is disclosed in co-pending application Ser. No. 08/942,088, entitled "Scroll Compressor With Economizer Fluid Passage Defined By An End Face Of Fixed Scroll". The positioning of the economizer ports is the inventive aspect of this invention.

As shown, a main suction inlet 30 communicates suction fluid to compression chambers defined between the fixed scroll wrap 22 and the orbiting scroll wrap 24. An inner seal point 32 is defined as having just passed over the economizer entry port 26. Similarly, an inner seal point 34 has just passed over the economizer entry port 28.

Once the orbiting scroll has moved over ports 26 and 28, the ports communicate with the compression chambers. Now, intermediate pressure fluid is injected from port 26 into chamber 33. The economizer port 28 now injects intermediate pressure fluid to the chamber 35.

At this position, the chamber 33 still has not been closed off from the main suction inlet 30. In the position shown in FIG. 1, there is still an entrance 39 to the chamber 33 which has not yet closed. Thus, the chamber 33 is at suction pressure, and there is little resistance to injection of additional intermediate pressure fluid through port 26 and into chamber 33. Similarly, chamber 35 is still not sealed, and fluid from port 28 can enter chamber 35. The entrance 37 still communicates between main suction inlet 30 and chamber 35.

The positioning of the economizer ports 26 and 28 such that they communicate with the chambers 33 and 35, respectfully, prior to the entrances 39 and 37, respectively, being closed, is inventive. In the prior art, the economizer ports do not communicate with the chambers until the outer seal points are closed.

At the position shown in FIG. 1 ports 26 and 28 have just been partially uncovered by orbiting scroll 24.

A discharge port 40 is shown at the central location on the scroll.

Applicant has invented a unique of method of positioning the economizer injection ports to communicate with the chambers prior to sealing. The injected fluid does not result in back flow to the main suction chamber or main inlet 30. The method of determining a position for the ports will now be disclosed.

Figure 2:
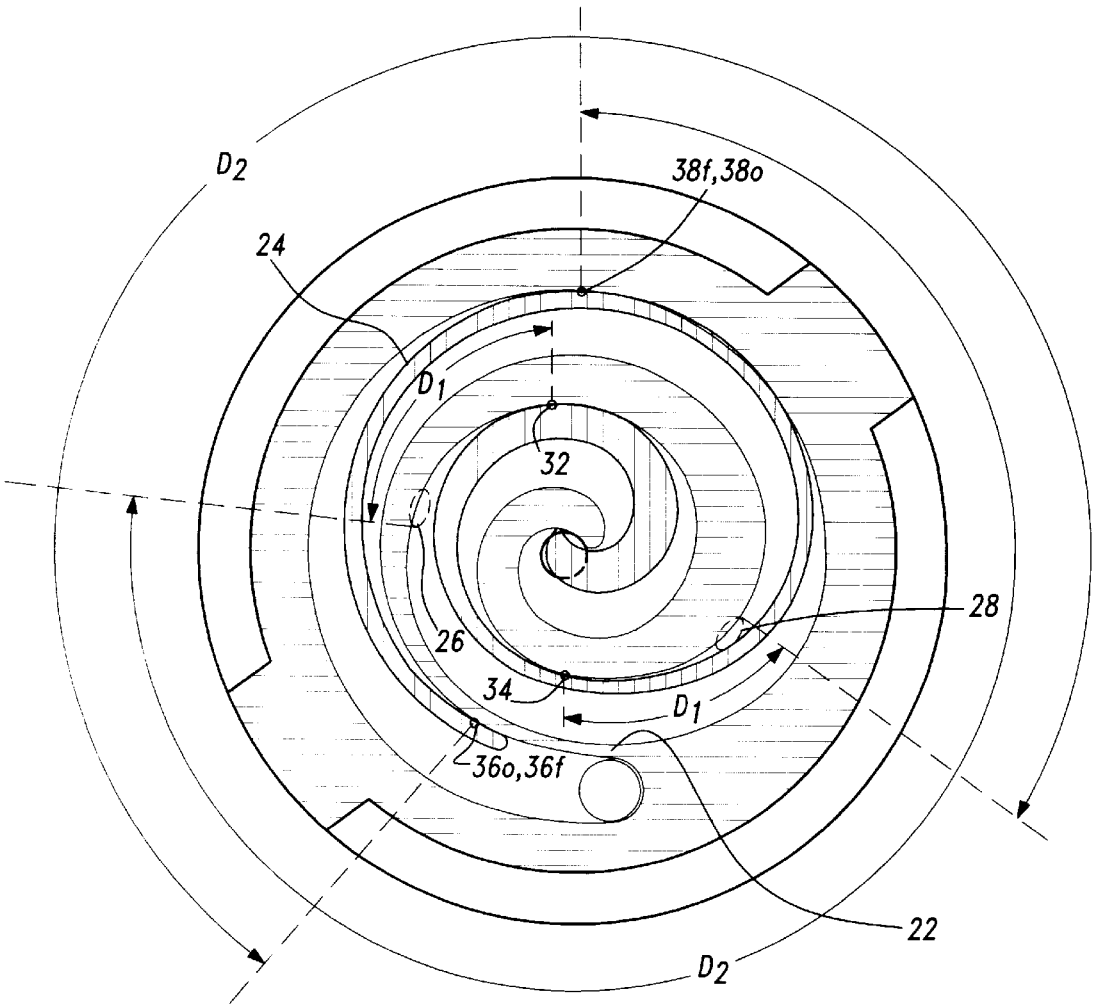
FIG. 2 shows a location in the cycle of the orbiting scroll slightly subsequent to that of FIG. 1, and at the point when the compression chambers have just been sealed from the main suction chamber.

As shown in FIG. 2, the orbiting scroll 24 has continued to move relative to the fixed scroll 22 from the FIG. 1 position. The outer seal points 36*o* and 36*f* are in contact, closing entrance 37 to chamber 35. Similarly, points 38*o* and 38*f* are in contact, closing entrance 39 to chamber 33. The location of the economizer ports 26 and 28 is selected such that a compression wave created in the chambers 33 and 35 by fluid injection from ports 26 and 28 does not reach the outer seal points 38 or 36 prior to the seal points being closed (i.e., the point shown in FIG. 2). In other words, the time that elapses between the opening of economizer ports 26 and 28 and the sealing of points 38 and 36 is less than or greater to the time needed for a compression wave to propagate from economizer ports 26 and 28 to points 38 and 36. In this way, the average pressure in chamber 33 and 35 is minimized, offering a low resistance to flow from ports 26 and 28 and thus maximizing the amount of injected economizer fluid, while there is still no back flow of injected fluid to the main suction chamber.

While positioning the economizer entry at any location which achieves the above goals is beneficial and inventive, there is an optimum position. The optimum location of the economizer entry ports can be defined by a formula relating four quantities. The first, $D_1$, is the distance between the inner seal points 32 or 34 at the location shown in FIG. 2, i.e. when outer seal points 38 or 36 have just closed, and the outer end of economizer ports 26 and 28, respectively. That is, the distance between the outermost end of the economizer ports and the inner seals points at the location when the outer seal points are initially made. This distance reflects the amount of fluid cycle between the beginning of injection, and the point where the chambers are closed.

$D_2$ is the distance from the outermost end of the economizer entry ports through the compression chambers and to the outer seal points 38 or 36 as measured around the compression chamber. The individual values of $D_2$ may be somewhat different for chambers 33 and 35. The formula for the optimum position is as follows:

$$\frac{D_1}{V_s} = \frac{D_2}{C}$$

$V_s$ is the velocity of the inner seal point 32 or 34 as it moves around the scroll wrap walls near economizer ports 26 or 28. The variable C is the velocity of sound through the refrigerant fluid at its operational condition. The $V_s$ factor should be known by the scroll designer as a function of scroll wrap geometry and operating speed. The C factor can be obtained from reference property tables for the particular expected refrigerant fluid and conditions.

The right hand side of the equation relates to the time after the opening of economizer paths 26 or 28 for the resulting compression wave to reach the outer seal point 38 or 36. The idealized position of the economizer ports is one wherein the two sides of the above equation are equal. In such a position, a compression wave from the fluid injected from the economizer ports reaches the outer seal point at the exact moment the seal point closes. However, to ensure that there is no back flow it may be prudent to not design to this ideal position. It might be prudent to err on having the left side of the equation slightly smaller than the right side. In other instances, such as when the injection port opening is very small and resistant to flow occurs at the start of the injection process, it might be prudent to err on having the left side of the equation slightly larger than the right side. In addition, the variables $V_s$ and C can never be known with exact precision, and an error factor might be incorporated into the design of the location of the economizer ports to account for this. At any rate, most preferably the scroll compressor is designed such that the two sides of the equation are approximately equal.

Essentially what the above equation recognizes is that the $D_1/V_s$ term on the left hand side of the equation is the amount of time after the economizer port first communicates with the compression chamber until the moment when the compression chamber is sealed. The right hand side of the equation calculates how long it will take the compression wave resulting from the injected fluid to reach the outer seal point. The right hand side must preferably be at least equal to, and typically greater than the left hand side such that the compression chamber seals before the compression wave reaches and passes the outer seal point.

The exact desired location of the economizer ports will differ with the particular geometries, sizes, speeds, pressures and refrigerants that are utilized in a particular scroll compressor. An interactive process may be utilized to optimize desired economizer injection port locations.

By providing an optimum location for the economizer entry ports, the invention increases capacity for the scroll compressor. In particular, an increase in fluid flow volumes of 5–10% through the economizer injection ports can be achieved with this invention.

This invention may be beneficial in any type compressor with an economizer circuit. In particular, a screw compressor may benefit from this invention. That is, the invention has benefits beyond scroll compressors.

A preferred embodiment of this invention has been disclosed, however, a worker of ordinary skill in the art would recognize certain modifications would come within the scope of this invention. For that reason the following claims should be studied to determine the true scope and content of this invention.

What is claimed is:

1. A scroll compressor comprising:

a non-orbiting scroll having a base and a spiral wrap extending from said base;

an orbiting scroll having a base and a spiral wrap extending from said base, said spiral wrap of said orbiting scroll interfitting with said spiral wrap of said non-orbiting scroll to define compression chambers, said orbiting scroll moving through an orbiting cycle relative to said non-orbiting scroll, said orbiting scroll wrap moving into and out of contact with said non-orbiting scroll wrap at an outer seal point such that compression chambers between said non-orbiting and orbiting scroll wrap are alternately opened and sealed, to entrap and seal a previously opened compression chamber;

an inner seal point of contact defining an inner end of said compression chambers; and at least one economizer port communicating with a source of fluid and extending through said base of one of said non-orbiting and orbiting scrolls to communicate with said compression chambers, said economizer port being positioned such that it communicates with said compression chamber prior to said orbiting scroll wrap coming into contact with said non-orbiting scroll wrap at said outer seal point.

2. A scroll compressor as recited in claim 1, wherein said economizer port extends through said non-orbiting scroll base.

3. A scroll compressor as recited in claim 1, wherein the location of said economizer port is selected such that a wave in said compression chamber due to said economizer port becoming open to said compression chamber does not reach said outer seal point until the approximate time said outer seal point is sealed to close said compression chamber.

4. A scroll compressor as recited in claim 3, wherein the location of said economizer port is selected based on the following formula:

$$\frac{D_1}{V_s} \text{ is approximately equal to } \frac{D_2}{C};$$

wherein $D_1$ is the distance between said economizer port and said inner seal point at the position where said outer seal point initially closes said compression chamber, $D_2$ is the distance as measured around the compression chamber between said economizer port and said outer seal point at the point when said outer seal point is initially made, $V_s$ is the speed of said inner seal point and C is the acoustical speed of sound in the particular refrigerant which is to be utilized in said compressor.

5. A scroll compressor as recited in claim 4, wherein there are two of said economizer ports, and two of said compression chambers being cyclically closed.

6. A scroll compressor comprising:

a non-orbiting scroll having a base and a spiral wrap extending from said base;

an orbiting scroll having a base and a spiral wrap extending from said base, said spiral wrap of said orbiting scroll intermitting with said spiral wrap of said non-orbiting scroll to define compression chambers, said orbiting scroll moving through an orbiting cycle relative to said non-orbiting scroll, said orbiting scroll moving into and out of contact with said non-orbiting scroll wrap at an outer seal point such that compression chambers between said non-orbiting and orbiting scroll wrap are alternately opened and sealed to entrap and seal a previously opened compression chamber;

inner seal points of contact defining an inner end of said compression chambers;

an economizer port communicating with a source of fluid extending through said base of said non-orbiting scroll to communicate with at least one of said compression chambers, said economizer port being positioned such that it communicates with said compression chamber prior to said orbiting and non-orbiting wraps coming into contact at said outer seal point to seal said compression chamber, the location of said economizer port being such that a compression wave in said compression chamber due to said economizer port becoming open to said compression chamber does not reach said outer seal point until the approximate time time said outer seal point is sealed to close said compression chamber.

7. A scroll compressor as recited in claim 6, wherein the location of said economizer port is based on the following formula:

$$\frac{D_1}{V_s} \text{ is approximately equal to } \frac{D_2}{C};$$

wherein $D_1$ is the distance between said economizer port and said inner seal point at the position where said outer seal point initially closes said compression chamber, $D_2$ is the distance as measured around the compression chamber between said economizer entry port and said outer seal point at the point when said outer seal point is initially made, $V_s$ is the speed of said inner seal point and C is the acoustical speed of sound in the particular refrigerant which is to be utilized in said compressor.

8. A scroll compressor as recited in claim 6, wherein there are two of said economizer ports, and two of said compression chambers being cyclically trapped and compressed.

9. A scroll compressor as recited in claim 6, wherein said wave reaches said seal point after said seal point is closed.

10. A method of operating a scroll compressor comprising the steps of:

(1) providing a non-orbiting scroll having a base and a spiral wrap extending from said base, an orbiting scroll having a base and a spiral wrap extending from said base;

(2) causing said orbiting scroll to be driven relative to said non-orbiting scroll such that an inner seal point on said orbiting scroll wrap contacts said non-orbiting scroll wrap to define an inner end of at least one compression chamber, and an outer seal point between said orbiting and non-orbiting scroll wraps being alternately brought into and out of contact to open and close said compression chamber to suction fluid; and (3) communicating an economizer port to a source of intermediate pressure fluid, and communicating said economizer port to said compression chamber at a point before said outer seal point is brought into contact to seal said compression chamber.

11. A method as recited in claim 10, wherein the location of said economizer port is selected such that a compression wave in said compression chamber due to fluid injected from said economizer port does not reach said outer seal point until the approximate time said outer seal point has moved into contact to seal said compression chamber.

12. A method as recited in claim 11, wherein the location of said economizer port is selected based on the following formula:

$$\frac{D_1}{V_s} \text{ is approximately equal to } \frac{D_2}{C};$$

wherein $D_1$ is the distance between said economizer port and said inner seal point at the position where said outer seal point initially closes said compression chamber, $D_2$ is the distance as measured around the compression chamber between said economizer entry port and said outer seal point at the point when said outer seal point is initially made, $V_s$ is the speed of said inner seal point and C is the acoustical speed of sound in the particular refrigerant which is to be utilized in said compressor.

13. A compressor comprising:

a compression chamber;

a main inlet, said compression chamber cyclically communicating with said main inlet and then being sealed from said main inlet to allow fluid in said compression chamber to be compressed; and an economizer circuit to supply supplemental fluid to said compression chamber, said economizer circuit beginning to communicate with said compression chamber before said compression chamber is sealed from said main inlet.

14. A compressor as recited in claim 13, wherein said compression chamber is provided by an orbiting and fixed scroll member.

15. A compressor as recited in claim 13, wherein said economizer circuit communicates and said compression chamber sealing are respectively timed so that a compression wave resulting from said economizer circuit communications does not reach said main inlet until approximately the time of said compression chamber sealing.

16. A scroll compressor as recited in claim 1, wherein said non-orbiting scroll is a fixed scroll.

17. A scroll compressor as recited in claim 6, wherein said non-orbiting scroll is a fixed scroll.

18. A method as set forth in claim 10, wherein said non-orbiting scroll is provided as a fixed scroll.

* * * * *